US006419613B2

(12) United States Patent
Stearns et al.

(10) Patent No.: US 6,419,613 B2
(45) Date of Patent: Jul. 16, 2002

(54) EXERCISE APPARATUS WITH ELEVATING SEAT

(76) Inventors: Kenneth W. Stearns, P.O. Box 55912, Houston, TX (US) 77255; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 09/796,123

(22) Filed: Feb. 28, 2001

Related U.S. Application Data

(63) Continuation-in-part of application No. 09/575,468, filed on May 22, 2000, now Pat. No. 6,251,047, which is a continuation of application No. 09/066,141, filed on Apr. 24, 1998, now Pat. No. 6,066,073.

(51) Int. Cl.[7] ..... A63B 23/04
(52) U.S. Cl. ..... 482/57; 482/4

(58) Field of Search ..... 482/1–9, 51, 57, 482/62, 63, 95, 96, 148

(56) References Cited

U.S. PATENT DOCUMENTS 4,790,528 A * 12/1988 Nakao et al. ..... 482/9
5,782,639 A * 7/1998 Beal ..... 482/96
5,803,870 A * 9/1998 Buhler ..... 482/8

* cited by examiner

*Primary Examiner*—Glenn E. Richman

(57) ABSTRACT

An exercise apparatus alters the elevation of a person based on the person's level of exertion. The exercise itself may involve bodily motion and/or isometric exercise performed by the person's arms and/or legs. The elevating process may be directly linked to the exercise motion and/or controlled electronically.

22 Claims, 16 Drawing Sheets

EXERCISE APPARATUS WITH ELEVATING SEAT

CROSS-REFERENCE TO RELATED APPLICATION

This application is a continuation-in-part of U.S. patent application Ser. No. 09/575,468, filed on May 22, 2000 and now U.S. Pat. No. 6,251,047, which is a continuation of U.S. patent application Ser. No. 09/066,141, filed on Apr. 24, 1998 now U.S. Pat. No. 6,066,073.

FIELD OF THE INVENTION

The present invention relates to exercise methods and apparatus and more particularly, to exercise methods and apparatus which selectively raise and lower an exercising person as a function of the person's level of exertion.

BACKGROUND OF THE INVENTION

Exercise equipment has been designed to facilitate a variety of exercise motions and/or to simulate a variety of real life activities. Although it is difficult to know for certain, the commercial success of an exercise product is often attributed to one or more specific factors. In some categories of products, such as cross-country ski machines, the quality of the exercise seems to be a significant factor. In other categories of products, such as treadmills, ease of use seems to be a significant factor, in addition to the quality of the exercise. In yet another category of products, known in the industry as rider machines, ease of use was a product feature, but the quality of the exercise was limited. Another possible explanation for the commercial success of rider machines is that the up and down movement of the exerciser's body added to the perceived value and/or overall enjoyment of the exercise. An object of the present invention is to provide exercise machines and methods which provide both quality exercise and psychological encouragement to the exerciser.

SUMMARY OF THE INVENTION

The present invention provides an exercise apparatus having a seat which is selectively movable relative to a base as a function of exercise exertion and/or force applied against a force receiving member. Generally speaking, the seat is moved upward from an underlying floor surface during relatively vigorous exercise, and the seat is moved downward during less vigorous exercise. In other words, the elevation of the seat relative to the floor surface provides a physical indication of the exertion level of the person exercising. The exercise activity may include exercise motion and/or isometric exercise involving a person's arms and/or legs. Various means may be employed to move the person up and down and/or to control the implementation of such movements. Many of the features and advantages of the present invention may become more apparent from the detailed description which follows.

BRIEF DESCRIPTION OF THE DRAWINGS

With reference to the Figures of the Drawing, wherein like numerals represent like parts and assemblies throughout the several views.

DETAILED DESCRIPTION OF THE PREFERRED EMBODIMENT

The present invention may be described conceptually in terms of an exercise workout involving application of force against a force receiving member by a person sitting on a seat. To the extent that the person exercises above a threshold level, the seat moves upward relative to an underlying floor surface. To the extent that the person exercises beneath a threshold level, the seat moves downward relative to an underlying floor surface. Although movement of the seat is a function of exertion relative to the force receiving member, the two members are not directly linked in a manner which requires contemporaneous motion. In other words, the seat may remain stationary in response to continuous movement of the force receiving member; or the seat may lower in response to discontinued movement of the force receiving member; or the seat may raise in response to continued pressure against a fixed force receiving member.

Once the underlying principles of the present invention are understood, those skilled in the art will recognize numerous ways to implement the general concept. Some of the design considerations include the type of exercise(s) to be performed; the manner in which the seat is to be moved; and the relationship to be established between the level of exertion and the elevation of the seat.

Figure 1:
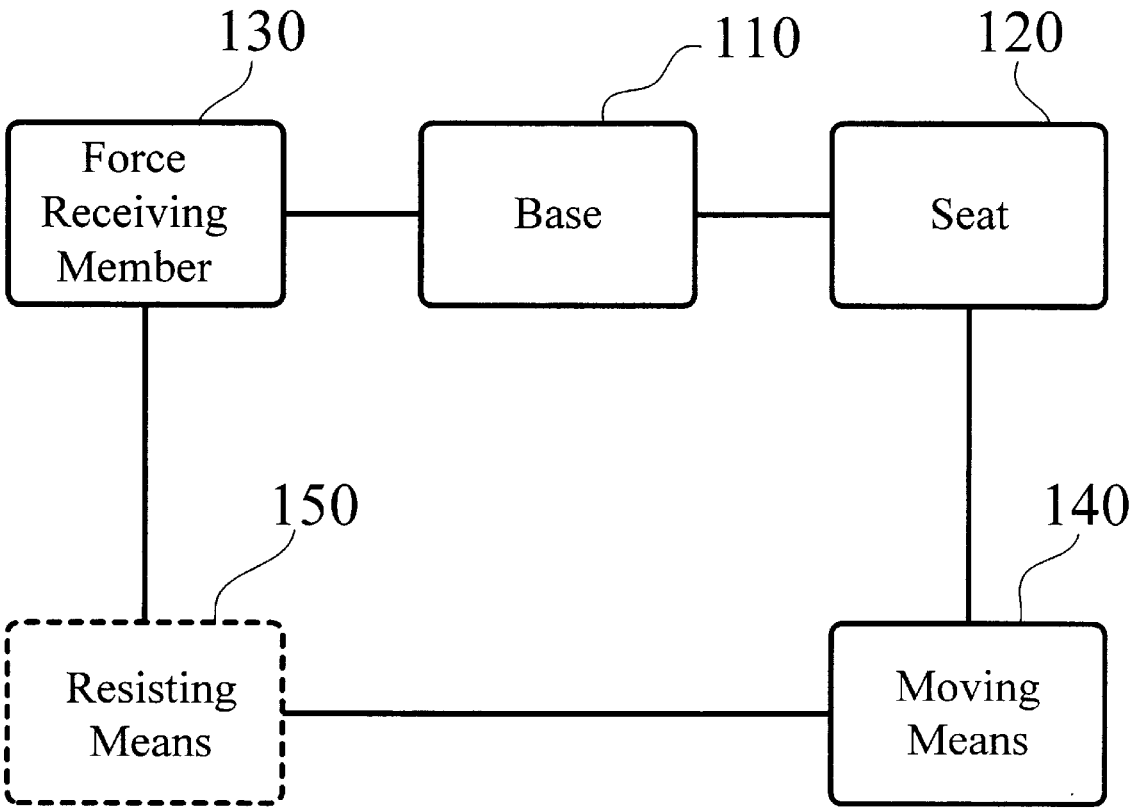
FIG. 1 is a diagrammatic representation of a first implementation of the present invention.

As shown diagrammatically in FIG. 1, one implementation of the present invention includes a seat 120 which is connected to a base 110 and movable in a generally vertical direction relative thereto for motivational purposes, and a force receiving member 130 which is connected to the base 110 and acted upon by an occupant of the seat 120 for exercise purposes. A moving means 140 is connected to the seat 120 and operable to move the seat 120 up and down relative to the base 110 under certain circumstances. As suggested by the dashed lines, a discrete resisting means 150 may optionally be connected to the force receiving member 130 to resist movement of the force receiving member 130 relative to the base 110.

Figure 2:
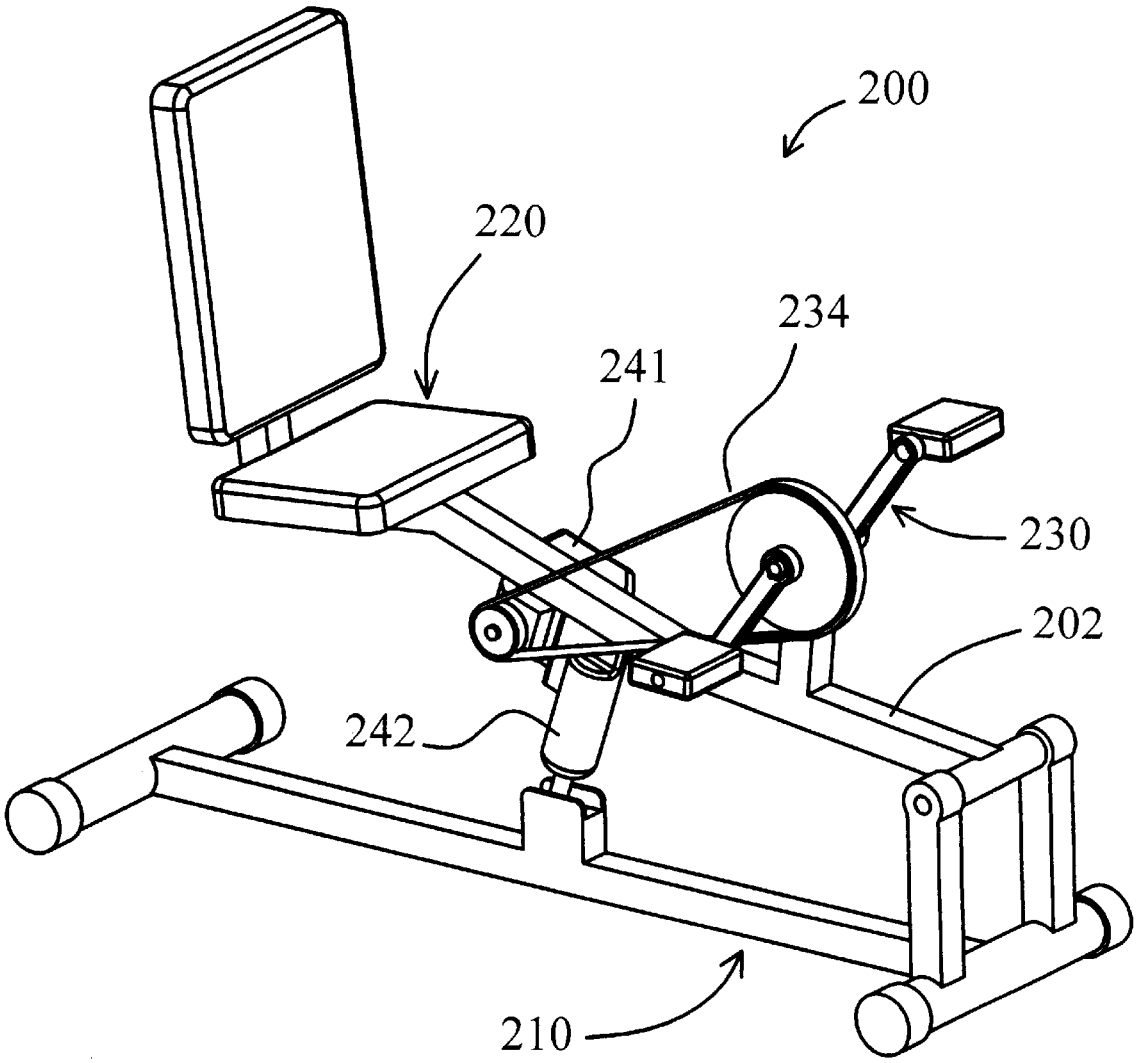
FIG. 2 is a perspective view of an exercise apparatus constructed according to the principles of the present invention and implemented in accordance with the diagram of FIG. 1.

The implementation set forth diagrammatically in FIG. 1 is embodied on an exercise apparatus designated as 200 in FIG. 2. The apparatus 200 includes a base 210 designed to rest upon a floor surface; a beam 202 having a front end pivotally mounted to a front end of the base 210; a seat 220 mounted on a rear end of the beam 202; a pedal assembly 230 rotatably mounted on an intermediate portion of the beam 202; a hydraulic pump 241 connected to the pedal assembly 230 (and stepped up) by means of a belt 234; and a hydraulic cylinder 242 connected to the pump 241 and extending between an intermediate portion of the beam 202 and an intermediate portion of the base 210.

A person sits on the seat 220 and places his feet on respective pedals of the pedal assembly 230. The seat 220 may be made adjustable along the beam 202 to accommodate people of different sizes, and/or that a flywheel may be connected to the pedal assembly 230 to add inertia to the system. In any event, rotation of the pedals drives the hydraulic pump 241, which in turn, pressurizes the hydraulic cylinder 242. Increased pressure in the cylinder 242, encourages the cylinder 242 to elongate, thereby moving the beam 202 upward relative to the base 210 and the underlying floor surface. In this embodiment 200, the pump 241 and the cylinder 242 cooperate to move the seat 220 and to resist movement of the force receiving members on the pedal assembly 230. As a result of this arrangement (and subject to certain limits), the more vigorously a person pedals, the higher he will be raised into the air. Since the pedal assembly 230 and the seat 220 are both mounted on the beam 202, they remain a fixed distance apart and in the same orientation relative to one another regardless of the elevation of the seat 220.

On this embodiment 200, an optional conventional check valve is disposed in a first, output line, extending from the pump 241 to the cylinder 242, in order to maintain pressure in the cylinder 242. Also on this embodiment, an optional conventional bleed valve is disposed in a second, return line, extending from the cylinder 242 to a reservoir and then to the pump 241, in order to allow the seat 220 to return downward in the absence of sufficient exercise activity. The bleed valve is adjustable to accommodate different exercise rates and/or people with different bodyweights.

Figure 3:
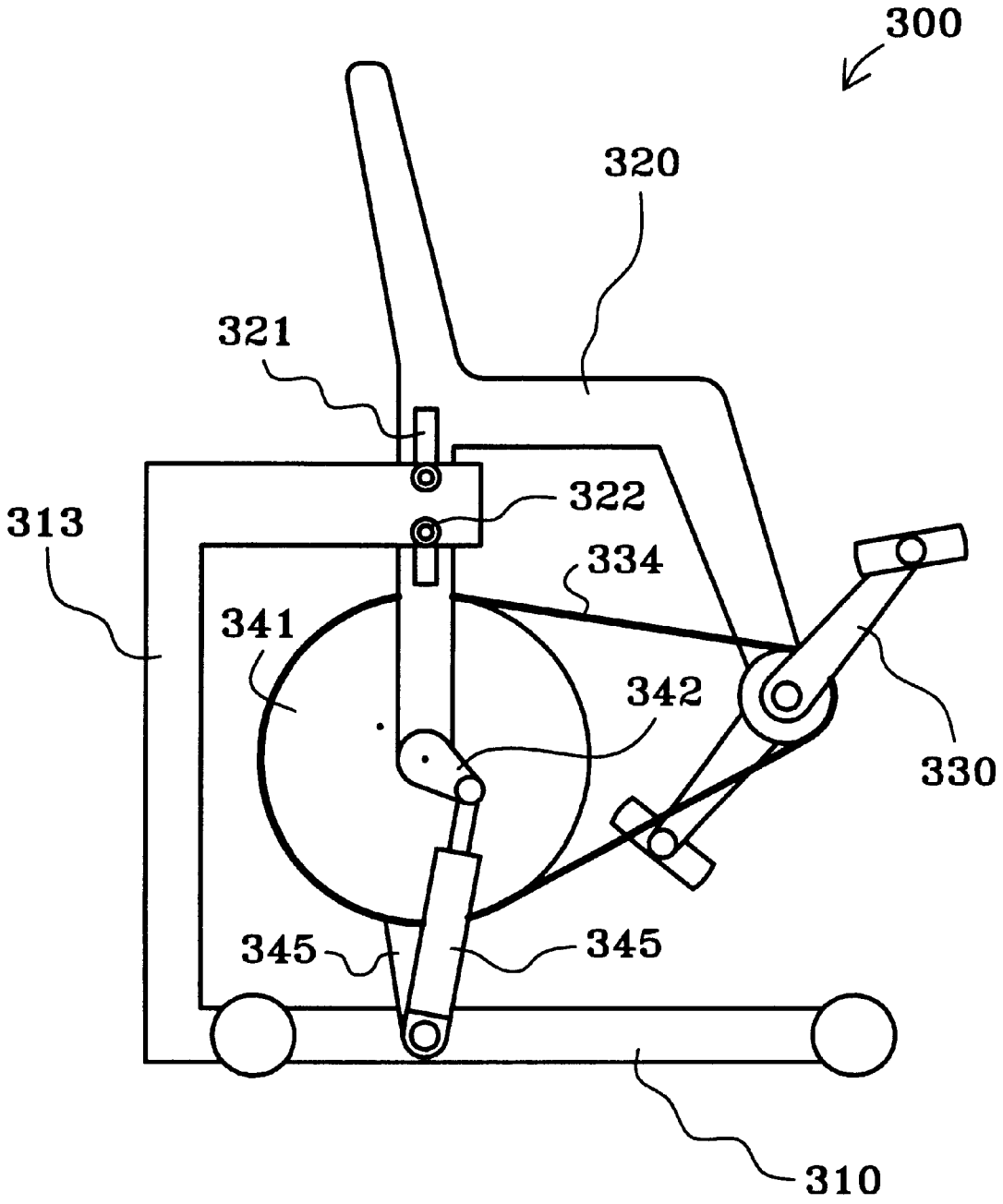
FIG. 3 is a side view of another exercise apparatus constructed according to the principles of the present invention and implemented in accordance with the diagram of FIG. 1.

The implementation set forth diagrammatically in FIG. 1 is also embodied on an exercise apparatus designated as 300 in FIG. 3. The apparatus 300 includes a base 310 designed to rest upon a floor surface; a rear stanchion 313 extending upward from the base 310; a seat 320 movably mounted on the stanchion 313 (by means of a vertical slot 321 and bolts 322); a pedal assembly 330 rotatably mounted relative to the seat 320; a relatively large diameter pulley 341 rotatably mounted relative to the seat 320 and connected to the pedal assembly 330 (and stepped down) by means of a belt 334 and a relatively small diameter pulley associated with the crank assembly 330; cranks 342 disposed on opposite sides of the pulley 341 and keyed thereto; and cylinders 345 disposed on opposite sides of the pulley 341 and extending between the pulley 341 and the base 310.

A person sits on the seat 320 and places his feet on the pedals of the pedal assembly 330. The pedal assembly 330 may be made adjustable relative to the seat 320 to accommodate people of different sizes. In any event, rotation of the pedals drives the pulley 341, which in turn, causes alternating extension and contraction of the cylinders 345. The cylinders 345 are resistant to the latter but not the former, so when they are subjected to compressive force, the cylinders 345 encourage the seat 320 to move upward relative to the base 310 and the underlying floor surface. As a result of this arrangement (and subject to certain limits), the more vigorously a person pedals, the higher he will be raised into the air. Since the pedal assembly 330 is mounted relative to the seat 320, they remain a fixed distance apart and in the same orientation relative to one another regardless of the elevation of the seat 320.

The cylinders 345 are provided with conventional bleed valves in order to allow the dissipation of pressure in the absence of sufficient exercise activity. The bleed valves are adjustable to accommodate different exercise rates and/or people with different bodyweights. The inertia of the assembly may be increased by connecting the pulley 341 to a flywheel, which may be "stepped up" by means known the art.

Figure 4:
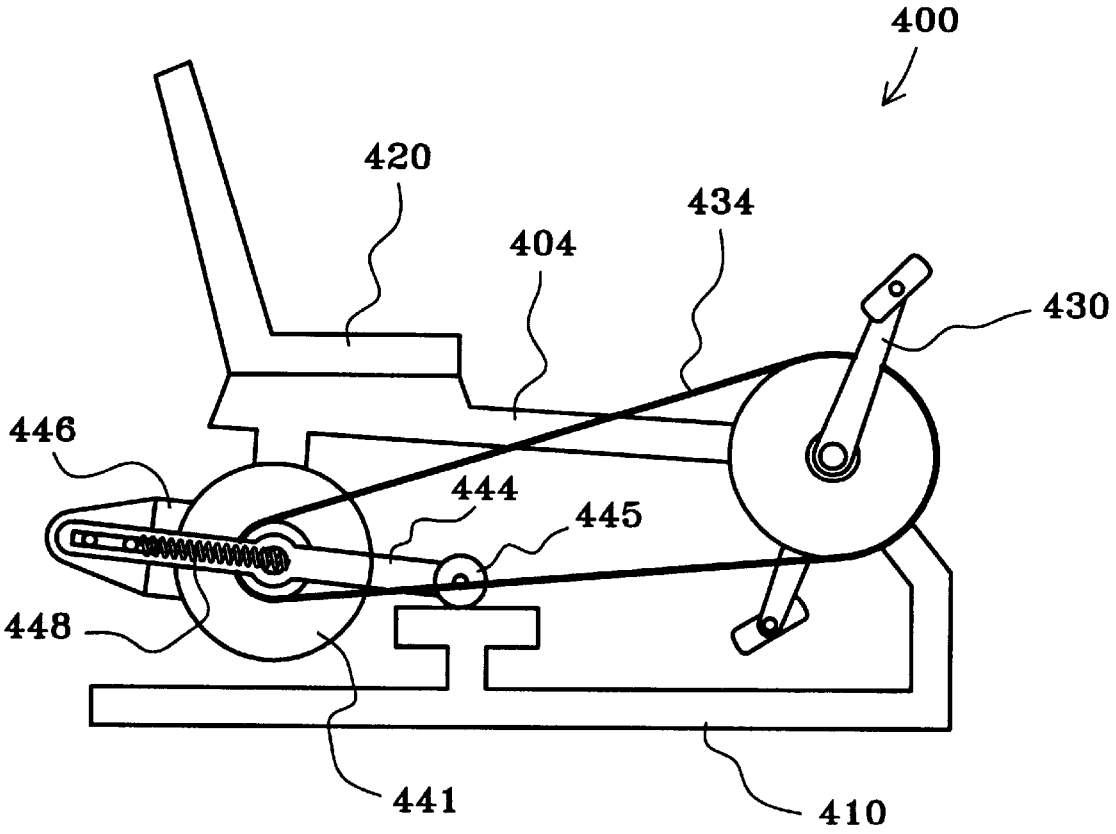
FIG. 4 is a side view of yet another exercise apparatus constructed according to the principles of the present invention and implemented in accordance with the diagram of FIG. 1.

The implementation set forth diagrammatically in FIG. 1 is also embodied on an exercise apparatus designated as 400 in FIG. 4. The apparatus 400 includes a base 410 designed to rest upon a floor surface; a frame member 404 pivotally mounted on the base. 410; a seat 420 mounted on the frame member 404; a pedal assembly 430 rotatably mounted relative to the frame member 404; a flywheel 441 rotatably mounted on the frame member 404 and connected to the pedal assembly 430 (and stepped up) by means of a belt 434; a torque transmitting assembly 444 having a first portion 445 which bears against the base 410 and a second portion 446 which bears against the flywheel 441; and a spring 448 which biases the second portion 446 of the torque transmitting assembly 442 toward the flywheel 441. The pedal assembly 430 and the frame member 404 share a common axis of rotation relative to the base 410.

In the depicted embodiment 400, the torque transmitting assembly 444 includes an elongate bar having an intermediate portion rotatably mounted relative to the frame member 404 and sharing an axis of rotation with the flywheel 441. The first portion 445 of the torque transmitting assembly 444 is a roller that is rotatably mounted on a first end of the bar and engages a bearing surface on the base 410. The second portion 446 of the torque transmitting assembly 444 is a brake pad that is movably mounted on a second, opposite end of the bar and engages a bearing surface on the flywheel 441.

Other torque transmitting assemblies may be substituted for the one shown in FIG. 4 without departing from the scope of the present invention. For example, one end of a bar could be rotatably mounted to the frame member; an opposite end of the bar could bear against the base, and a brake pad could be disposed therebetween and biased against the flywheel. In any event, a force dampening cylinder may be rotatably interconnected between the frame member and the base to dampen downward movement of the seat relative to the base.

With reference to the embodiment shown in FIG. 4, a person sits on the seat 420 and places his feet on the pedals of the pedal assembly 430. The pedal assembly 430 may be made adjustable relative to the seat 420 to accommodate people of different sizes. In any event, rotation of the pedals drives the flywheel 441, which in turn, rubs against the brake pad 446. Frictional forces between the brake pad 446 and the flywheel 441 apply a moment force against the elongate bar (clockwise in FIG. 4), thereby encouraging the frame member 404 to move upward relative to the base 410 and the underlying floor surface. As a result of this arrangement (and subject to certain limits), the more vigorously a person pedals, the higher he will be raised into the air. Since both the seat 420 and the pedal assembly 430 are mounted on the frame member 404, they remain a fixed distance apart and in the same orientation relative to one another regardless of the elevation of the seat 420. The bias force acting on the brake pad 446 is adjustable to accommodate different exercise rates and/or people with different bodyweights.

Figure 5:
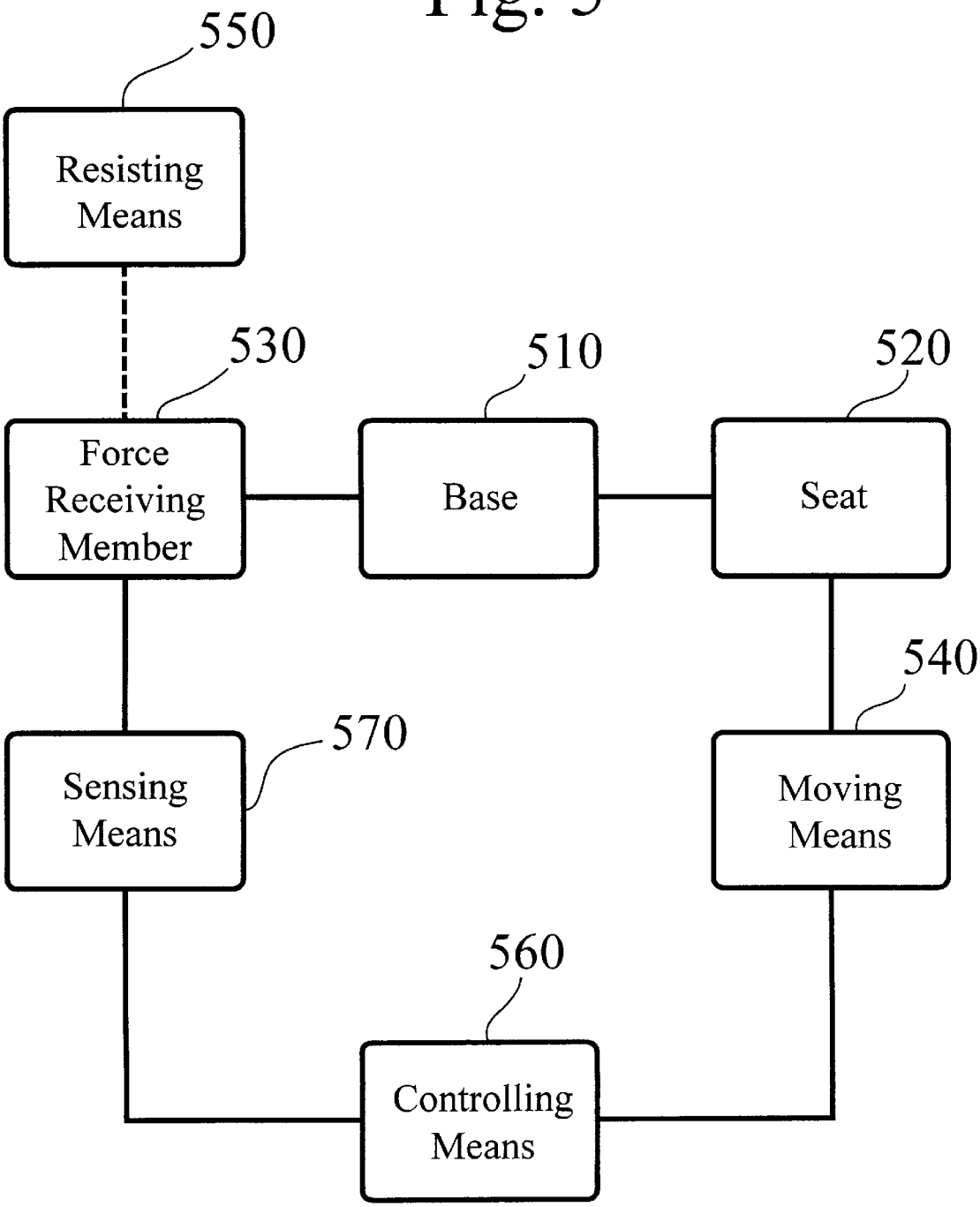
FIG. 5 is a diagrammatic representation of a second implementation of the present invention.

Another way to implement the present invention is shown diagrammatically in FIG. 5. This second implementation of the present invention includes a seat 520 which is connected to a base 510 and movable in a generally vertical direction relative thereto for motivational purposes, and a force receiving member 530 which is connected to the base 510 and acted upon by an occupant of the seat 520 for exercise purposes. A moving means 540 is connected to the seat 520 and operable to move the seat 520 up and down relative to the base 510 under certain circumstances. As suggested by the dashed lines, a discrete resisting means 550 may optionally be connected to the force receiving member 530 to resist movement of the force receiving member 530 relative to the base 510.

A controlling means 560 is connected to both the moving means 540 and to a sensing means 570 in communication with the force receiving member 530. This arrangement is well suited for controlling the moving means 540 as a function of the speed of exercise movement and/or the magnitude of force applied during exercise movement, but independent of the resisting means 550, if any. For example, as long as a person continues to perform a given amount of work, the seat 520 will move or remain upward. At times when the person is not performing the prescribed amount of work, the seat 520 will move or remain downward.

The controller 560 may also be programmed to facilitate interval training and/or allow brief periods of rest during a workout. For example, the person may be required to perform a certain amount of work within a time interval in order to move upward one level. The person may then be afforded a time interval within which to relax or exert less energy without dropping a level. Subsequently, the person may again be required to repeat the higher exertion of energy in order to move upward another level or remain elevated.

Figure 6:
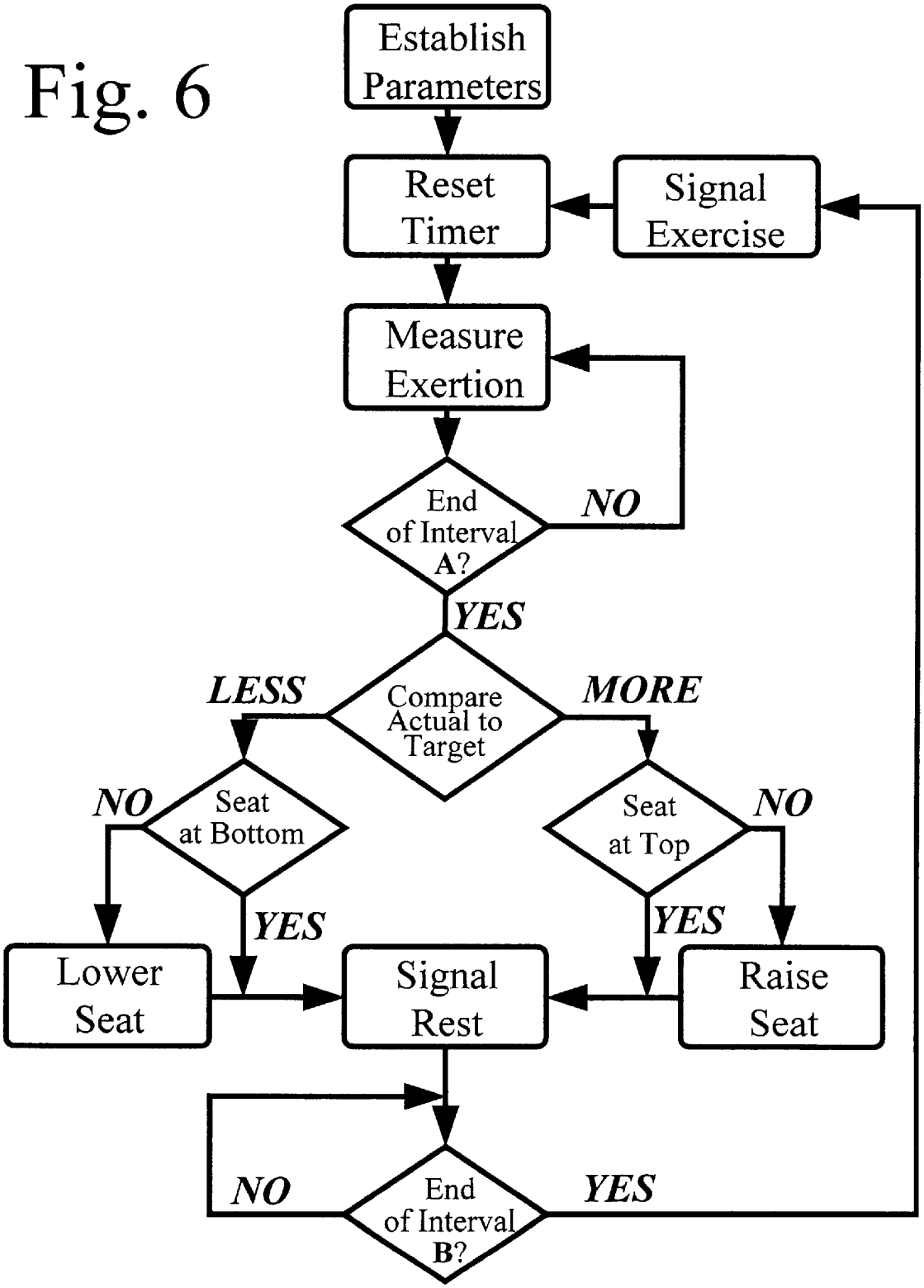
FIG. 6 is a flow chart for a control program suitable for use with the implementation of FIG. 5.

The controller 560 may be programmed in accordance with the flow chart shown in FIG. 6, for example. First, parameters are established, including determination of a target level of exertion (a "user entered" exercise speed will be used for purposes of discussion). A timer is reset and then the speed of exercise motion is measured for a time interval A. At the end of the time interval A, if the measured or actual speed is greater than the target speed, then the seat is either raised or maintained at the highest elevation. A rest signal is transmitted to the person in the seat, and a delay (which may be another parameter entered by the user) occurs before a subsequent exercise signal is transmitted to the person in the seat. The process then repeats with the reset of the timer. If the measured or actual speed is less than the target speed, then the seat is either lowered or maintained at the lowest elevation, before the rest signal is transmitted to the person in the seat.

Figure 7:
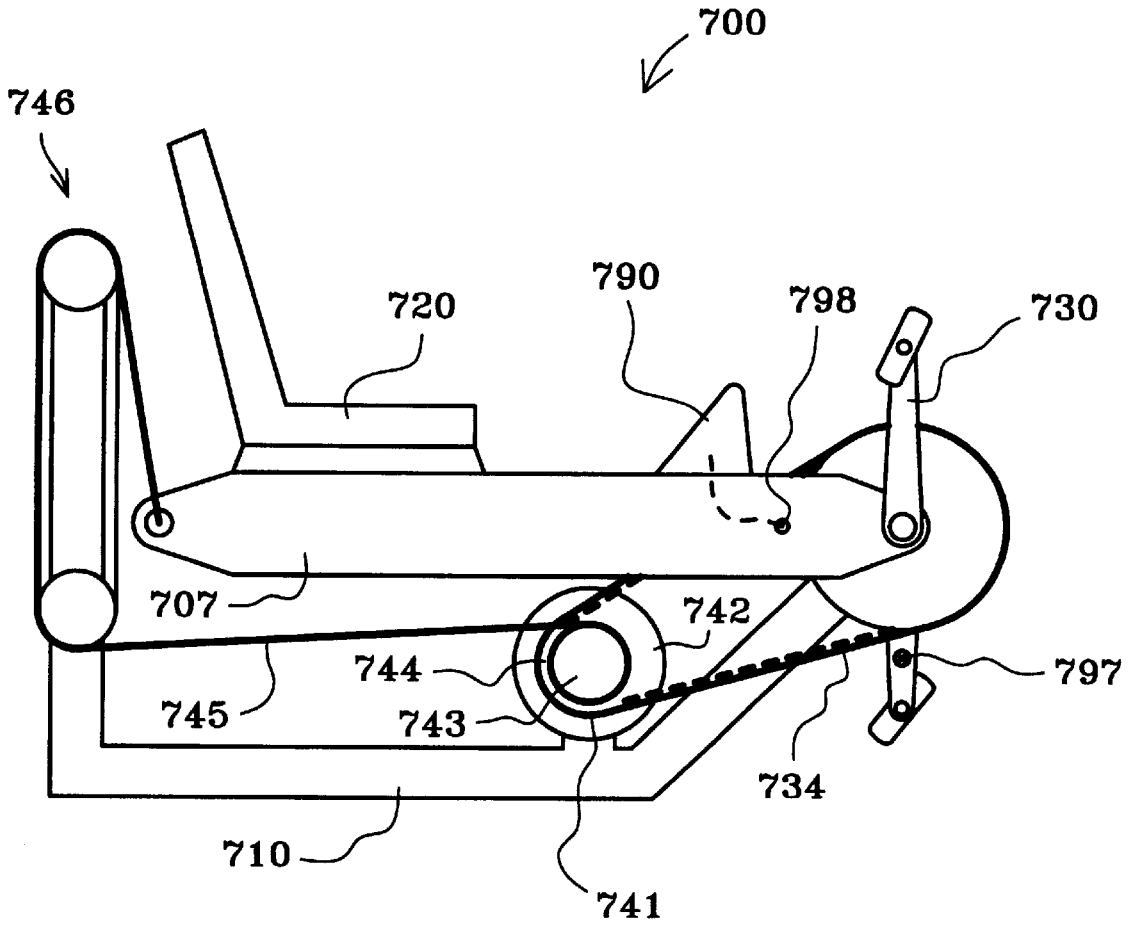
FIG. 7 is a side view of an exercise apparatus constructed according to the principles of the present invention and implemented in accordance with the diagram of FIG. 5.

The implementation set forth diagrammatically in FIG. 5 is embodied on an exercise apparatus designated as 700 in FIG. 7. The apparatus 700 includes a base 710 designed to rest upon a floor surface; a beam 707 having a front end pivotally mounted to a front end of the base 710; a seat 720 mounted on a rear end of the beam 707; a user interface 790 mounted on an intermediate portion of the beam 707; a pedal assembly 730 rotatably mounted on the front end of the base 710 (such that the rotational axis defined by the pedal assembly 730 coincides with the pivotal axis defined by the beam 707); sensing components 797 and 798 mounted on the pedal assembly 730 and the front end of the base 710, respectively; a first pulley 741 rotatably mounted on the base 710 and connected to the pedal assembly 730 (and stepped up) by means of a belt 734; a flywheel 742 rotatably mounted on the base 710 and rigidly connected to the first pulley 741; a second pulley 743 rotatably mounted on the base 710 and connected to the first pulley 741 by means of a conventional electric clutch 744; and a cable 745 extending from the second pulley 743, through a pulley system 746 on the rear end of the base 710, to the rear end of the beam 707.

A person sits on the seat 720 and places his feet on the pedals of the pedal assembly 730. The seat 720 may be made adjustable along the beam 707 to accommodate people of different sizes. In any event, rotation of the pedals drives the first pulley 741 and flywheel 742, which in turn, act upon the electric clutch 744. Sufficient torque on the electric clutch 744 encourages the second pulley 743 to rotate (clockwise in FIG. 7) and wind up some of the cable 745, thereby pulling the beam 707 upward relative to the base 710 and the floor surface. As a result of this arrangement (and subject to certain limits), the more vigorously a person pedals, the higher he will be raised into the air. Since the seat 720 pivots about the rotational axis of the pedal assembly 730, they remain a fixed distance apart and in the same orientation relative to one another regardless of the elevation of the seat 720.

The sensing components 797 and 798 function in a manner known in the art to measure the rotational velocity of the pedal assembly 730. The user interface 790 compares the actual velocity to the target velocity and adjusts the electric clutch 744 accordingly to effect changes in the elevation of the seat 720. One or more lights on the user interface 790 are used to indicate when the seat occupant should be exercising vigorously and/or when he should be conserving energy. The electric clutch 744 may be replaced by a slip clutch arrangement which provides resistance to torque as a function of rotational velocity.

Figure 16:
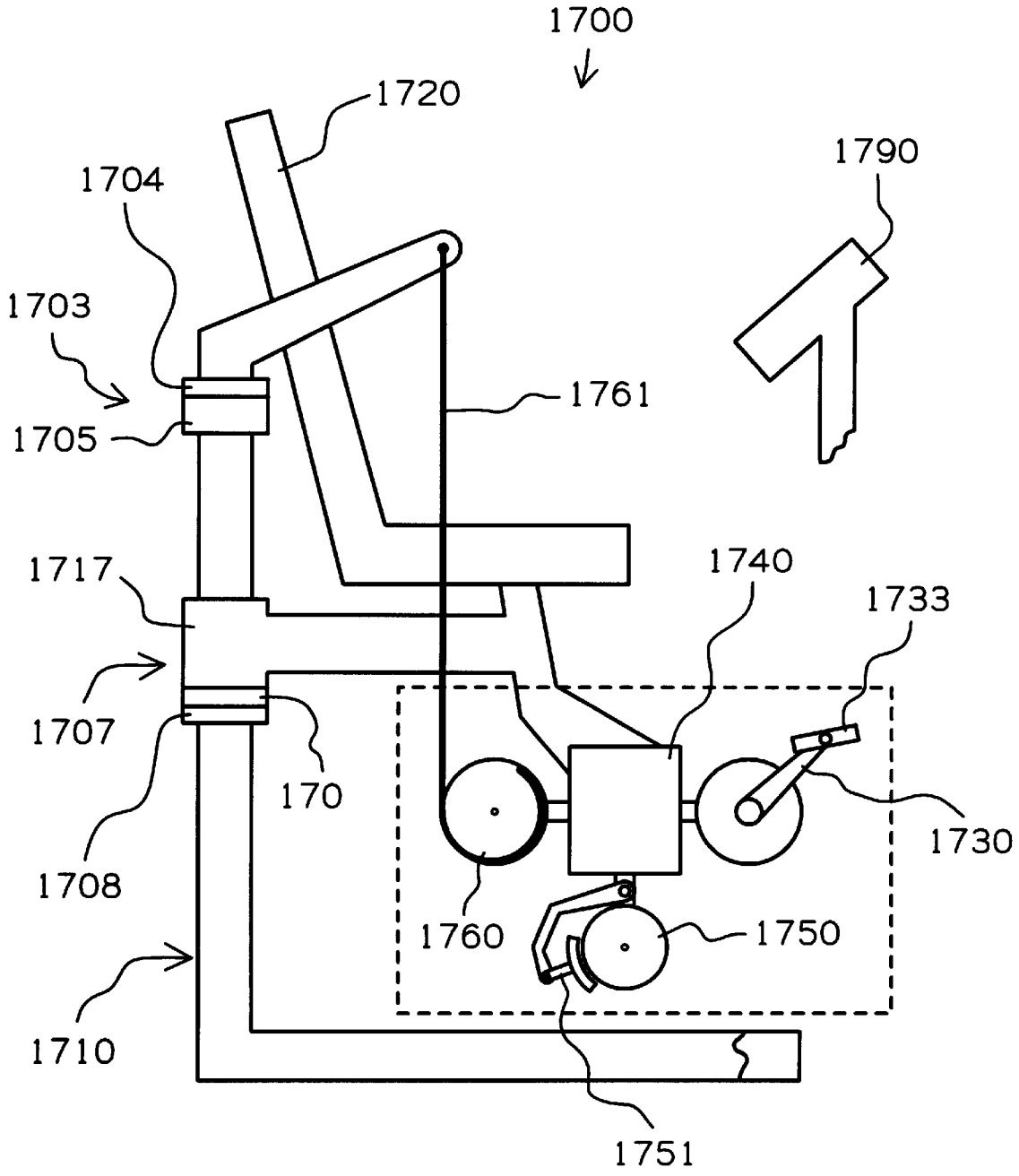
FIG. 16 is partially fragmented, side view of still another exercise apparatus constructed according to the principles of the present invention.

FIG. 16 shows an exercise apparatus 1700 that shares certain operational characteristics with the preceding embodiment 700. The exercise apparatus 1700 includes a frame 1710 having a base designed to rest upon a floor surface, and a mast or stanchion extending upward from a rearward end of the base. A bracket 1717 is slidably mounted on the mast, and extends forward to support a seat 1720. A user interface 1790 is mounted on a discrete portion of the frame 1710 (another stanchion extending upward form a forward end of the base, for example).

A differential assembly 1740 is mounted on a lower portion of the bracket 1717, generally beneath the seat 1720. A first shaft on the differential is connected to a pedal assembly 1730, which provides left and right pedals 1733 that are positioned for use by a person sitting on the seat 1720. A second shaft on the differential is connected to a drum or sheave 1760. A cable 1761 has a first end secured to the sheave 1760, and an opposite, second end secured to an upper end of the rearward mast on the frame 1710. A third shaft on the differential is connected to a rotating member 1750, and a conventional resistance device, such as friction brake 1751, is connected to the member 1750. Sensing components may be mounted on the pedal assembly 1730 and/or the bracket 1717 to sense the rotational velocity of the pedals 1733.

A person sits on the seat 1720 and places his feet on the pedals 1733 of the pedal assembly 1730. The seat 1720 may be made adjustable along the bracket 1717 to accommodate people of different sizes. In any event, rotation of the pedals 1733 is linked to rotation of the first differential shaft. In response to a control signal, the differential 1740 transmit the energy associated with rotation of the pedals 1733 to the member 1750 and/or the sheave 1760. Sufficient torque on the sheave 1760 causes winding of the cable 1761 and upward movement of the seat 1720. Conversely, insufficient torque on the sheave 1760 results in unwinding of the cable 1761 and downward movement of the seat 1720. The resistance device 1751 acts on the member 1750 to dissipate excess energy in the system. As a result of this is arrangement (and subject to certain limits), the more vigorously a person pedals, the higher he will be raised into the air.

Operation of the exercise apparatus 1700 may be controlled in a manner similar to the previous embodiment 700, or in other suitable ways. Operation of the exercise apparatus 1700 may also be described with reference to various states of operation. In an initial state of operation, the bracket 1717 rests on a lower stop that is secured to the frame 1710. The stop 1707 preferably includes a rigid plate 1708 and a resilient bumper 1709. The control program will measure the rotational speed of the pedals 1733 and cause the differential 1740 to begin lifting the bracket 1717, assuming that any performance requirements are being met.

During steady state operation, the bracket 1717 occupies a position above the stop 1707 and beneath an upper stop 1703 on the frame 1710. The upper stop 1703 similarly includes a rigid plate 1704 and a resilient bumper 1705. So long as any performance requirements are being met, the control program will continue to adjust the differential 1740 to keep the bracket 1717 in this intermediate position. The stops 1707 and 1703 are provided to limit travel of the bracket 1717, and to absorb energy if and when the bracket 1717 moves to either extreme. In the alternative, the control program may be designed to prevent the bracket 1717 from reaching its upper extreme, and to gently lower the bracket 1717 to its lower extreme. The control program may also be designed to advise the user to decrease exercise activity in order to keep the bracket 1717 from reaching its upper extreme, or to increase exercise activity in order to keep the bracket 1717 from reaching its lower extreme. This same sort of method may be used in response to exercise force, as opposed to speed, and/or to lift inanimate weights, as opposed to body weight.

Figure 8:
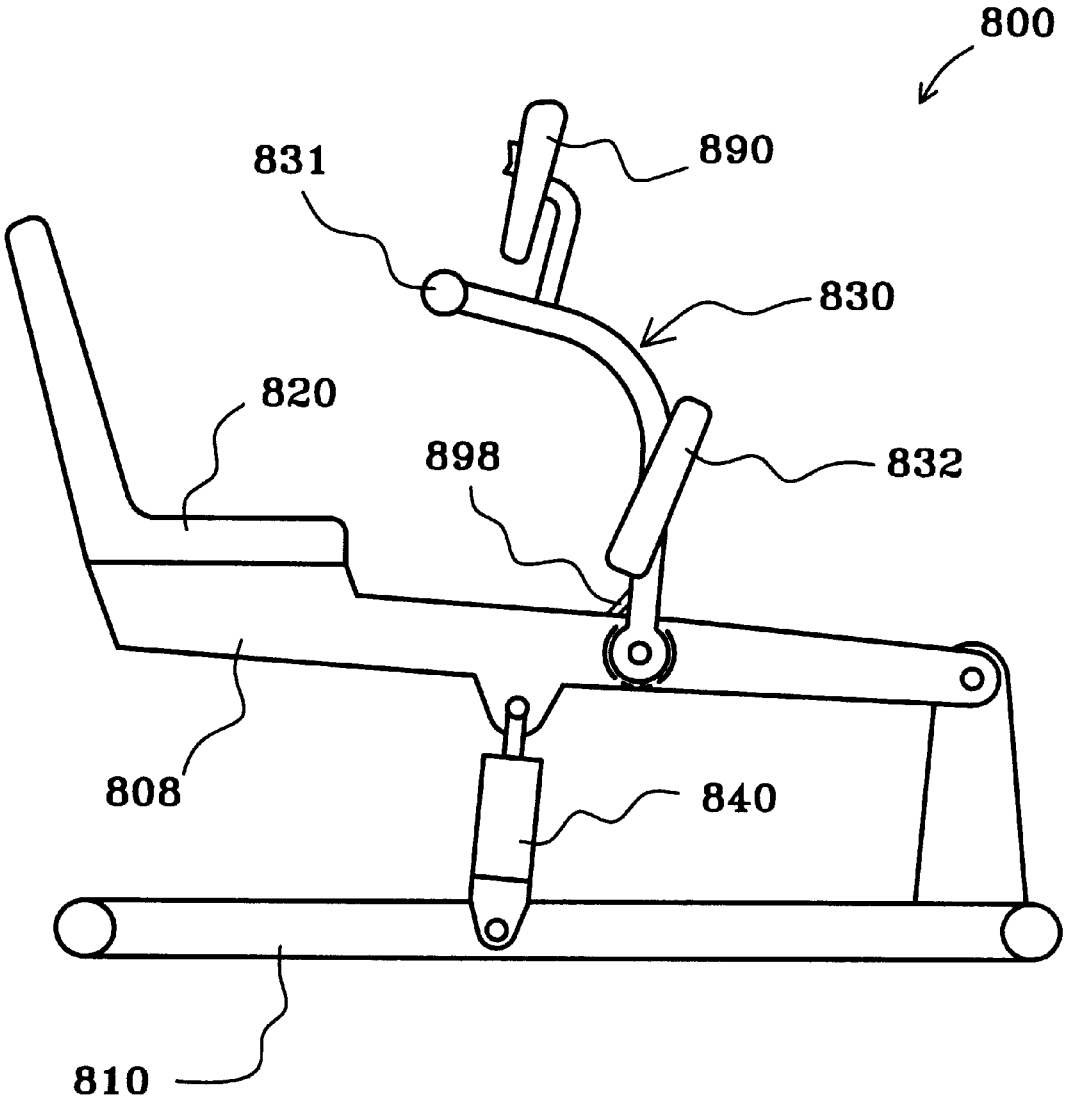
FIG. 8 is a side view of another exercise apparatus constructed according to the principles of the present invention and implemented in accordance with the diagram of FIG. 5.

Another embodiment of the implementation set forth diagrammatically in FIG. 5 is designated as 800 in FIG. 8. The apparatus 800 includes a base 810 designed to rest upon a floor surface; a beam 808 having a front end pivotally mounted to a front end of the base 810; a seat 820 mounted on a rear end of the beam 808; a force receiving member 831 or 832 rigidly mounted on an intermediate portion of the beam 808 (by welding, for example); a user interface 890 rigidly mounted on the force receiving member 830; a sensor 898 connected to the force receiving member 830; and a motorized lead screw or linear actuator 840 interconnected between the base 810 and the beam 808 and in communication with the user interface 890.

A person sits on the seat 820 and places his hands on the force receiving member 830. The seat 820 may be made adjustable along the beam 808 to accommodate people of different sizes. In any event, force applied against either force receiving member 831 or 832 is measured by the sensor 898 (using piezoelectric technology or another method known in the art) and transmitted to the controller 890, which compares the measured force to a preset range of forces. The controller 890 then signals the actuator 840 to move the beam 808 to an elevation indicative of the relationship between the measured force and the preset range of forces. As a result of this arrangement (and subject to certain limits), the more force a person exerts, the higher he will be raised into the air. Since the seat 820 and the force receiving member 830 are both mounted on the beam 808, they remain a fixed distance apart and in the same orientation relative to one another regardless of the elevation of the seat 820. As discussed above, if so desired, rest intervals may be programmed into the routine without corresponding reductions in elevation.

Figure 9:
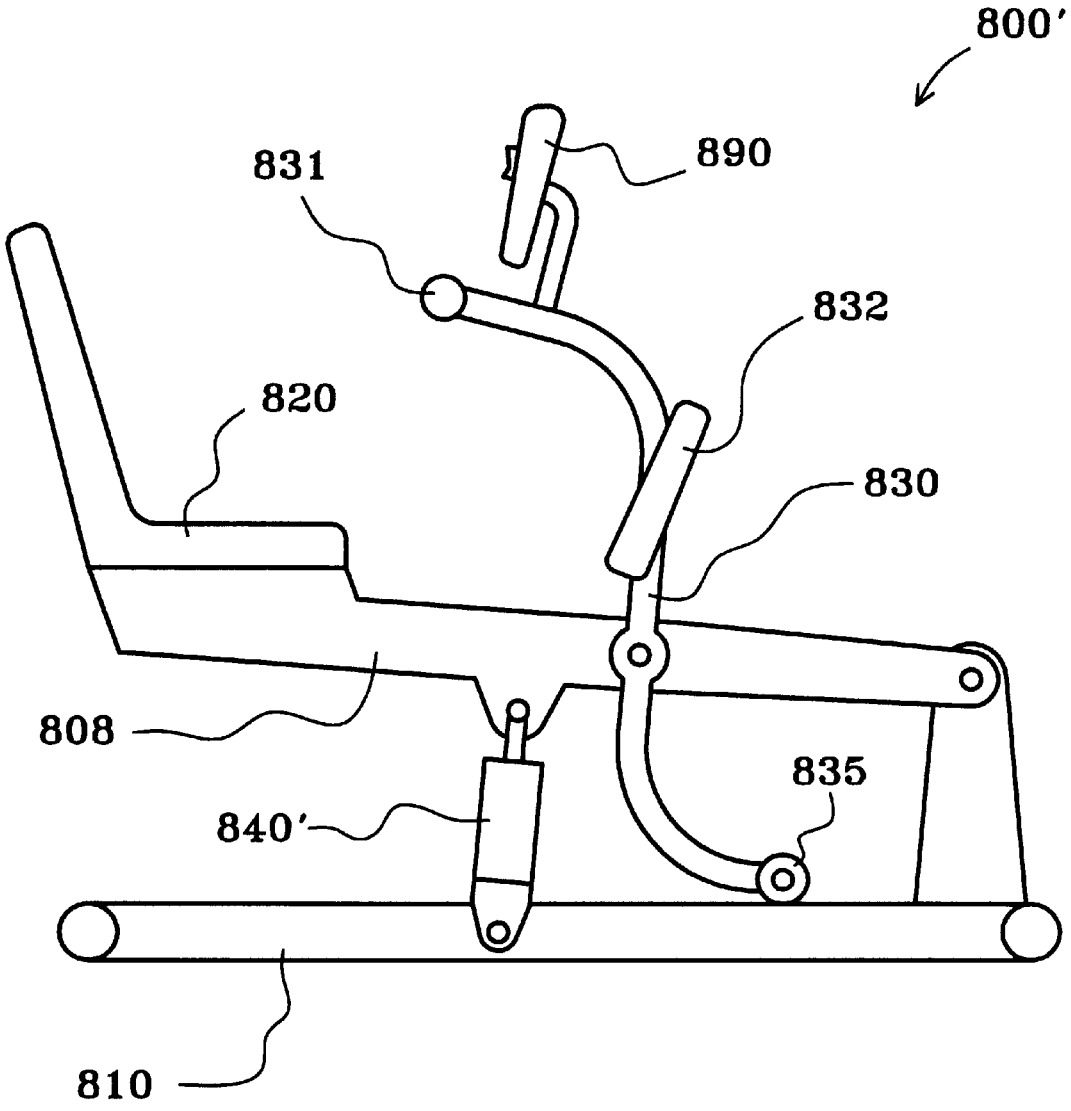
FIG. 9 is a side view of yet another exercise apparatus constructed according to the principles of the present invention and implemented in accordance with the diagram of FIG. 5.

FIG. 9 shows a modified embodiment 800' of the previous embodiment 800. In particular, the force receiving members 831 and 832 are rigidly mounted on an upper end of a bar 830. An intermediate portion of the bar 830 is rotatably mounted on the beam 808, and a lower end of the bar 830 supports a roller 835 which bears against the base 810. In this modified embodiment 800' the adjustable length member 840' may be a motorized lead screw or linear actuator (like on the previous embodiment 800) which helps the user force himself upward, or in the alternative, it may be a linear damper which dampens downward movement of the beam 808 relative to the base 810 in the absence of sufficient user-supplied force. When a linear actuator is provided, a sensor should be included to measure how much force is being exerted by the user.

Figure 10:
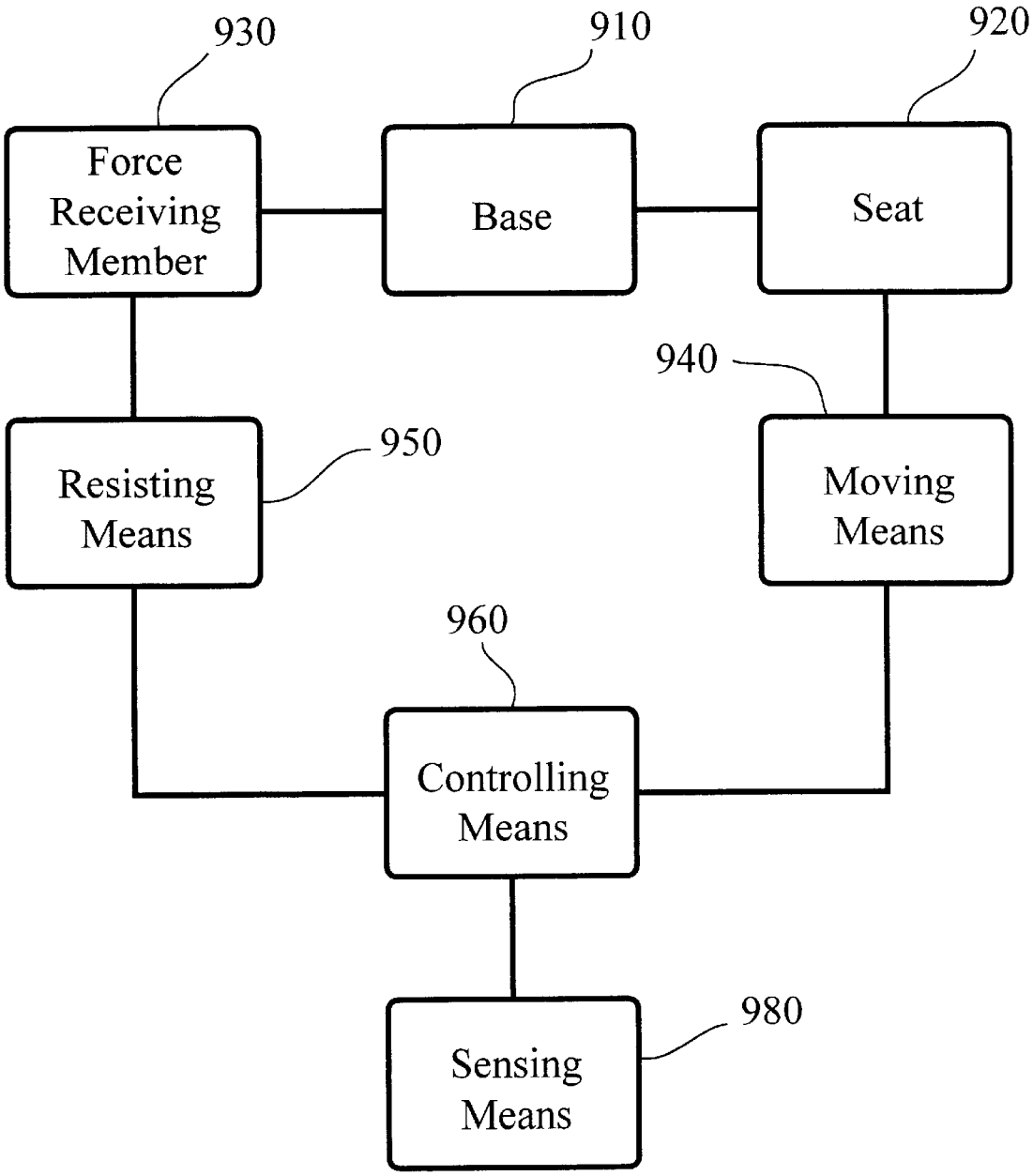
FIG. 10 is a diagrammatic representation of a third implementation of the present invention.

Yet another implementation of the present invention is shown diagrammatically in FIG. 10. This third implementation of the present invention includes a seat 920 which is connected to a base 910 and movable in a generally vertical direction relative thereto for motivational purposes, and a force receiving member 930 which is connected to the base 910 and movable relative to the base 910 for exercise purposes. A moving means 940 is connected to the seat 920 and operable to move the seat 920 up and down relative to the base 910 under certain circumstances. A discrete resisting means 950 is connected to the force receiving member 930 to resist movement of the force receiving member 930 relative to the base 910.

In addition to the components provided in the first implementation, a controlling means 960 is connected to the moving means 940, the resisting means 950, and a sensing means 980. This arrangement is well suited for controlling the moving means 940 independent of the resisting means 950. In one scenario, for example, the sensing means 980 is a conventional pulse monitor which functions to measure the heart rate of the occupant of the seat 920. As long as a person's heart rate is within a desired range, the seat 920 moves upward or remains elevated, and the resistance remains constant. At times when the person's heart rate is below the desired range, the seat 920 moves downward or remains low, and the resistance is increased. At times when the person's heart rate is above the desired range, the seat 920 moves upward or remains elevated, and the resistance is lowered. Many other control methods may be implemented in the alternative. For example, the apparatus may simply advise the user to speed up or slow down under certain circumstances, or in the case of a direct drive force receiving member, the apparatus may simply cause the force receiving member to move faster or slower when appropriate.

Figure 11:
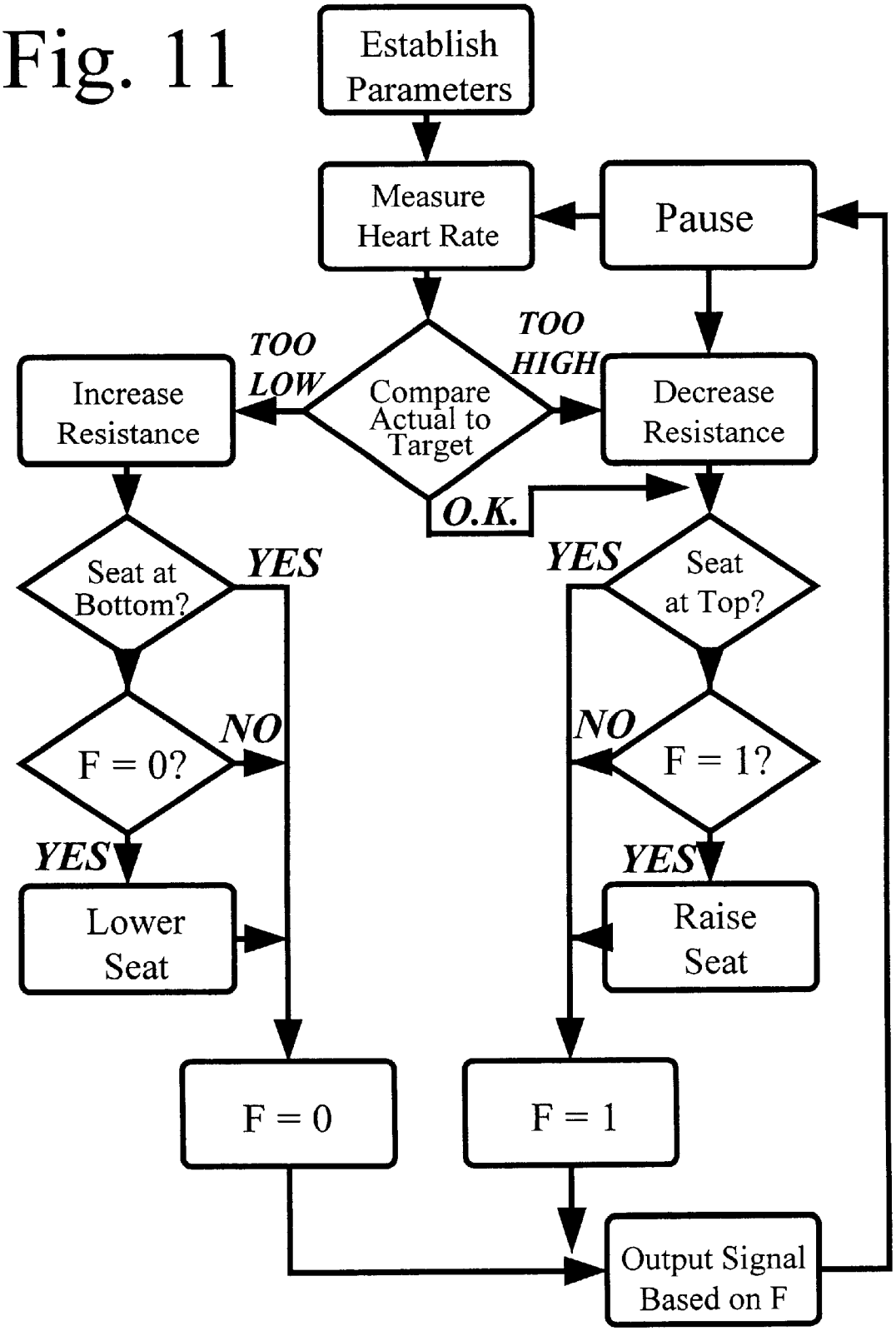
FIG. 11 is a flow chart for a control program suitable for use with the implementation of FIG. 10.

The controller 960 may be programmed in accordance with the flow chart shown in FIG. 11, for example. First, parameters are established, including determination of a heart rate range, which may be calculated based on entry of the user's age, and perhaps adjusted at the discretion of the user. As the seat occupant begins exercising, his heart rate is measured and then compared to the target range. If the heart rate is too low, then the resistance is increased, and the seat 920 remains bottomed out or is lowered if the previous comparison also indicated an infrequent heart rate. A flag is then set to zero to indicate that the latest comparison indicated a heart rate which is too low. If the heart rate is too high, then the resistance is lowered, and the seat 920 remains topped out or is raised if the previous comparison also indicated a relatively high heart rate. The flag is then set to one to indicate that the latest comparison indicated a heart rate which is at least high enough. If the heart rate is within the acceptable range, then the resistance is maintained, and the seat 920 remains topped out or is raised if the flag is one. The flag is then set to one. In any event, after the flag has been set, the value of the flag is used to send an appropriate output signal to the seat occupant. After a pause (which may be a user-programmed parameter), the current heart rate is compared to the target range, and the process is repeated.

Figure 12:
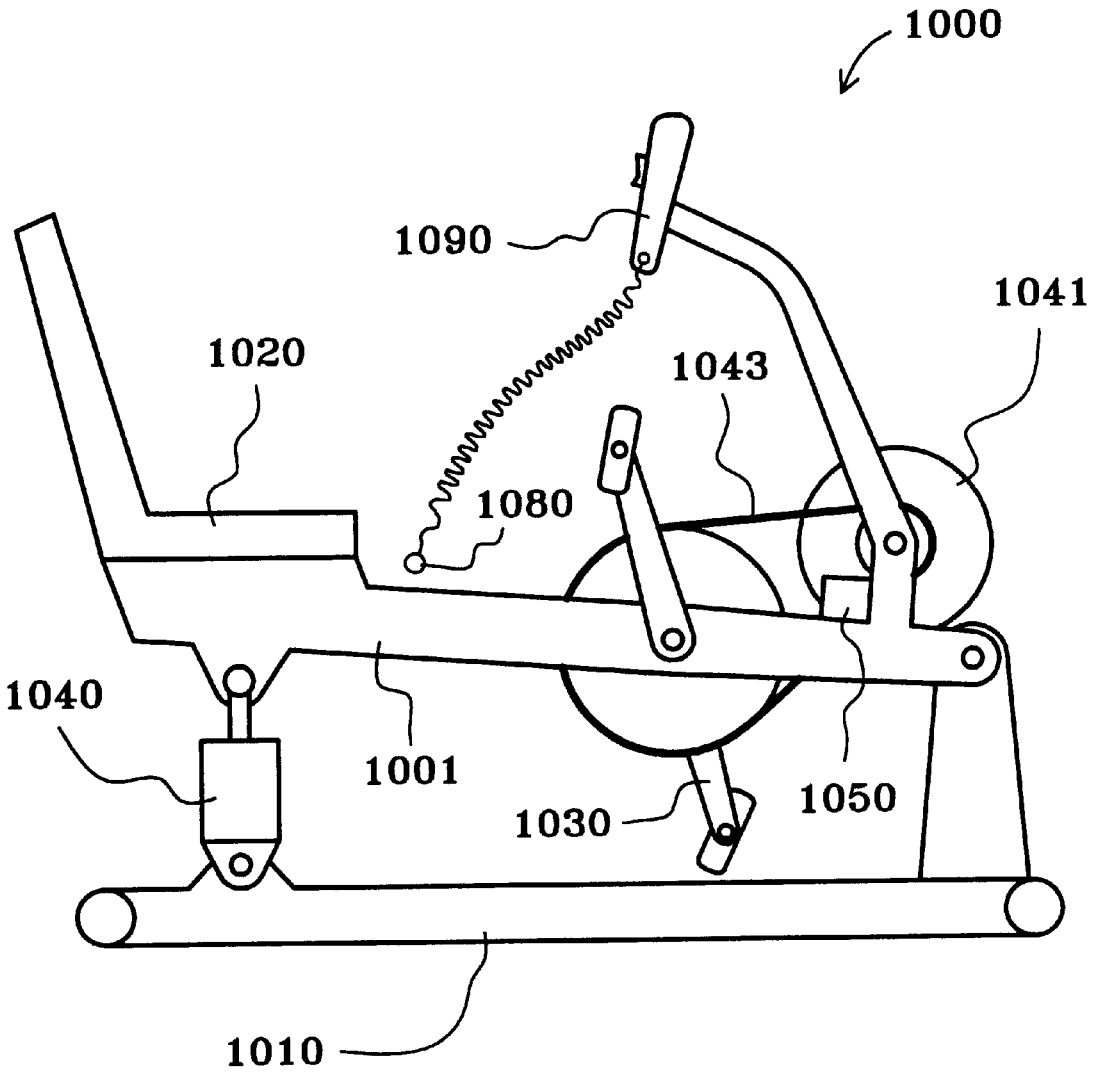
FIG. 12 is a side view of an exercise apparatus constructed according to the principles of the present invention and implemented in accordance with the diagram of FIG. 10.

The implementation set forth diagrammatically in FIG. 10 is embodied on an exercise apparatus designated as 1000 in FIG. 12. The apparatus 1000 includes a base 1010 designed to rest upon a floor surface; a beam 1001 having a front end pivotally mounted to a front end of the base 1010; a seat 1020 mounted on a rear end of the beam 1001; a pedal assembly 1030 rotatably mounted on an intermediate portion of the beam 1001; a user interface 1090 mounted on the pedal assembly; a pulse monitor 1080 in communication with the user interface 1090; a motorized lead screw 1040 extending between the beam 1001 and the base 1010 and in communication with the user interface 1090; a flywheel 1041 connected to the pedal assembly 1030 (and stepped up) by a belt 1043; and an electronically adjustable brake 1050 operatively connected to the flywheel 1041 and in communication with the user interface 1090 (as indicated by a dashed line).

A person sits on the seat 1020 and places his feet on the pedals of the pedal assembly 1030. The seat 1020 may be made adjustable along the beam 1001 to accommodate people of different sizes. In any event, rotation of the pedals drives the flywheel 1041 subject to resistance from the brake 1050. The pulse monitor 1080 measures the person's heart rate, and the user interface 1090 functions in accordance with the flow chart shown in FIG. 11 to adjust the brake 1050 and/or the lead screw 1040 accordingly. As, a result of this arrangement (and subject to certain limits), the more vigorously a person pedals, the higher he will be raised into the air. Since the seat 1020 and the pedal assembly 1030 are both mounted on the beam 1001, they remain a fixed distance apart and in the same orientation relative to one another regardless of the elevation of the seat 1020.

Figure 13:
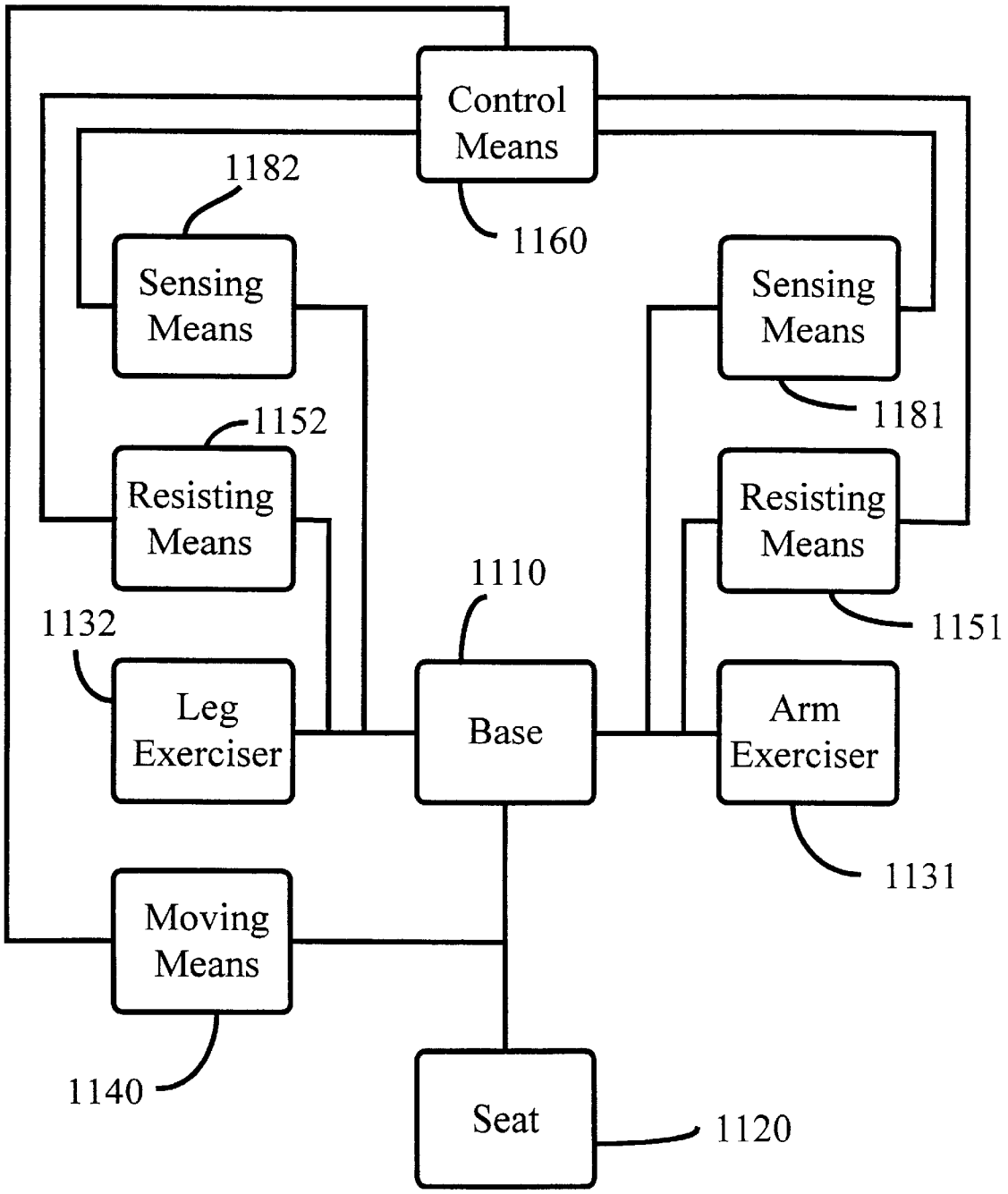
FIG. 13 is a diagrammatic representation of a fourth implementation of the present invention.

Still another implementation of the present invention is shown diagrammatically in FIG. 13. This third implementation of the present invention includes a seat 1120 which is connected to a base 1110 and movable in a generally vertical direction relative thereto for motivational purposes, and force receiving members 1131 and 1132 which are connected to the base 1110 and movable relative to the base 1110 for exercise purposes. A moving means 1140 is connected to the seat 1120 and operable to move the seat 1120 up and down relative to the base 1110 under certain circumstances. Discrete resisting means 1151 and 1152 are connected to respective force receiving members 1131 and 1132 to resist movement thereof relative to the base 1110.

In addition to the components provided in the first implementation, a controlling means 1160 is connected to the moving means 1140, both resisting means 1151 and 1152, and a discrete sensing means 1181 and 1182 for each of the force receiving members 1131 and 1132. This arrangement is well suited for controlling the moving means 1140 independent of the resisting means 1151 and 1152. In one scenario, for example, the sensing means 1181 and 1182 are conventional sensors which function to measure the combined work being performed by a user's arms and legs. As long as the person performs sufficient work, the seat 1120 moves upward or remains elevated, and a signal is transmitted to indicate satisfactory performance. At times when the person is not performing sufficient work, the seat 1120 moves downward or remains low, and a signal is transmitted to indicate unsatisfactory performance.

Figure 14:
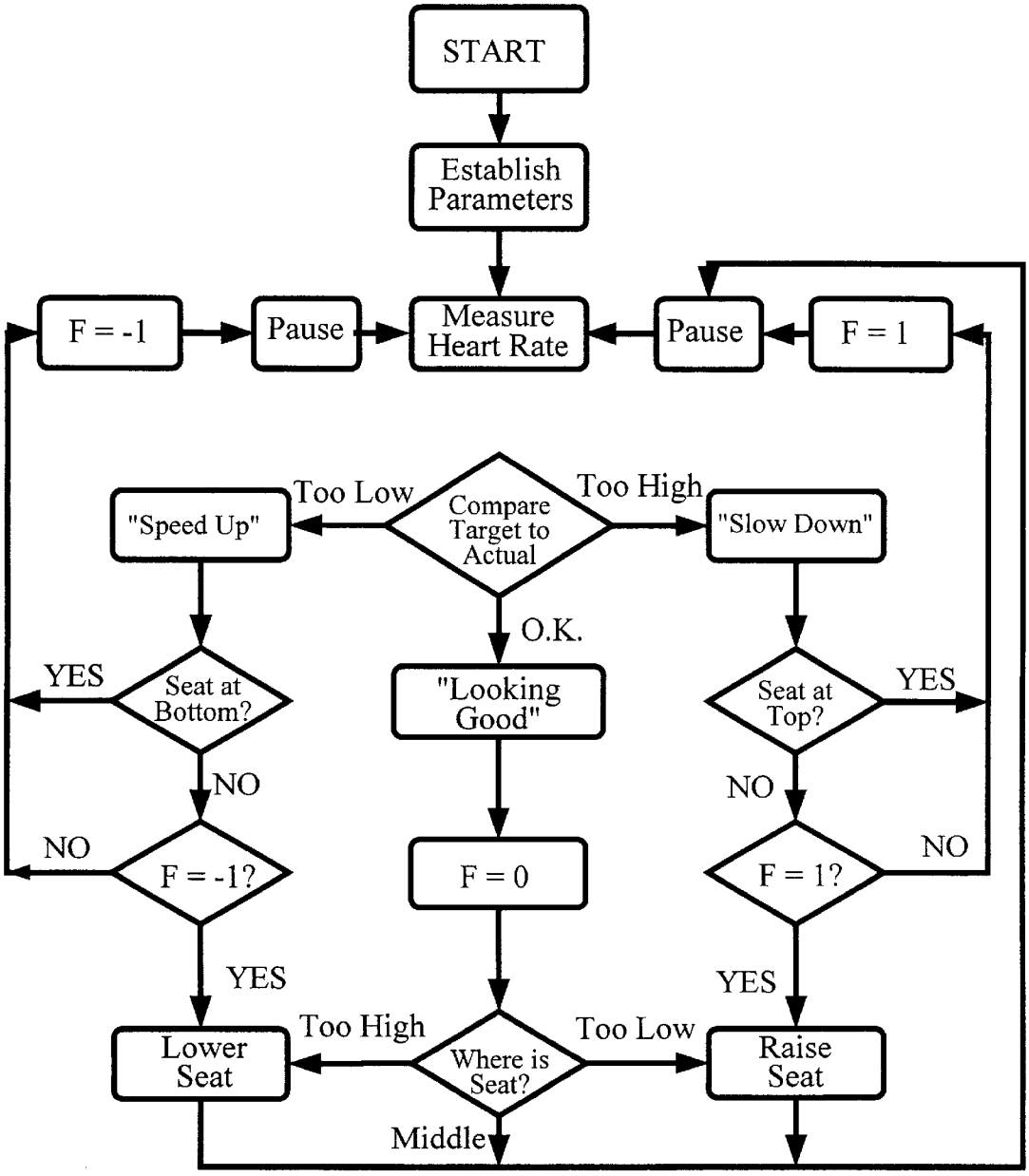
FIG. 14 is a flow chart for a control program suitable for use with the implementation of FIG. 13.

In another scenario, the controller 1160 may be programmed in accordance with the flow chart shown in FIG. 14, for example. First, parameters are established, including determination of a heart rate range, which may be calculated based on entry of the user's age, and perhaps adjusted at the discretion of the user. As the seat occupant begins exercising, his heart rate is measured and then compared to the target range.

If the heart rate is too low, then the seat 1120 remains bottomed out or is lowered if the previous comparison also indicated an infrequent heart rate. Action is then taken to encourage an increase in the heart rate. Such action may include a signal urging the user to go faster and/or an increase in the resistance to exercise. A flag is then set to (−1) to indicate that the latest comparison indicated a heart rate which is too low.

If the heart rate is too high, then the seat 1120 remains topped out or is raised if the previous comparison also indicated a relatively high heart rate. Action is then taken to encourage a decrease in the heart rate. Such action may include a signal urging the user to go slower and/or a decrease in the resistance to exercise. The flag is then set to (+1) to indicate that the latest comparison indicated a heart rate which is too high.

If the heart rate is within the acceptable range, then the seat 1120 remains "centered" or is moved toward the middle of its range of motion. The flag is set to (0), and a signal may be transmitted to indicate acceptable performance. Depending on the routine, the resistance may or may not be altered.

Figure 15:
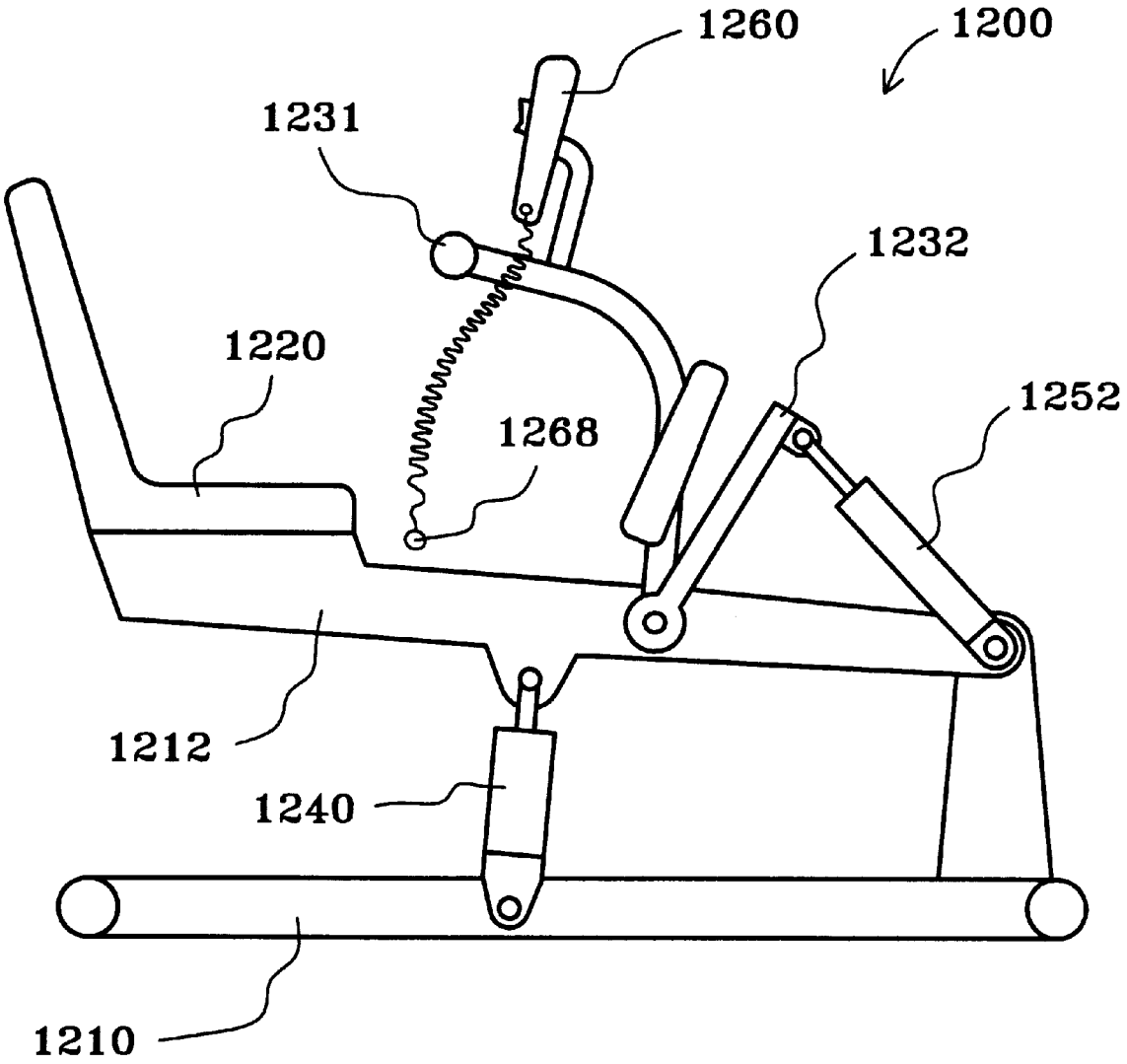
FIG. 15 is a side view of an exercise apparatus constructed according to the principles of the present invention and implemented in accordance with the diagram of FIG. 13.

The implementation set forth diagrammatically in FIG. 13 is embodied on an exercise apparatus designated as 1200 in FIG. 15. The apparatus 1200 generally includes a base 1210 designed to rest upon a floor surface; a beam 1212 having a front end pivotally mounted to a front end of the base 1210; a seat 1220 mounted on a rear end of the beam 1212; left and right arm exercise members 1231 rotatably mounted on an intermediate portion of the beam 1212; conventional friction brakes (not shown) interconnected between the beam 1212 and respective arm exercise members 1231; left and right leg exercise members 1232 rotatably mounted on an intermediate portion of the beam 1212; conventional dampers 1252 rotatably interconnected between the beam 1212 and respective leg exercise members 1231; a controller/interface 1260 mounted on the pedal assembly; a pulse monitor 1268 in communication with the controller 1260; and a linear actuator 1240 rotatably interconnected between the beam 1212 and the base 1210 and in communication with the controller 1260.

A person sits on the seat 1220 and places hands on the arm exercise members 1231 and his feet on the leg exercise members 1232. The seat 1220 may be made adjustable along the beam 1212 to accommodate people of different sizes. In any event, the pulse monitor 1268 measures the person's heart rate as he exerts force against the arm exercise members 1231 and/or the leg exercise members 1232. The controller 1260 functions in accordance with the flow chart shown in FIG. 14 to provide an indication of performance and/or make adjustments to either or both resistance mechanisms. As a result of this arrangement, the apparatus 1200 will encourage a person to exercise at a preferred rate and also position the person at an elevation which is indicative of the person's actual heart rate relative to a target heart rate. Since the seat 1220 and the exercise members 1231 and 1232 are mounted on the beam 1212, their spatial relationships relative to one another are unaffected by change in the elevation of the seat 1220.

The foregoing description and accompanying drawings set forth specific embodiments and particular applications of the present invention. Recognizing that many features and/or observations associated with different embodiments may be mixed and matched in various ways to arrive at additional embodiments, and/or that this disclosure will enable those skilled in the art to recognize still more embodiments and/or improvements, the scope of the present invention is to be limited only to the extent of the claims which follow.

What is claimed is:

1. An exercise apparatus, comprising:

a stationary base;

a body support movably mounted on said base;

an adjustable length support interconnected between said body support and said base;

a pedal assembly movably mounted on said body support; and a means for adjusting elevation of said body support relative to said base, wherein said means adjusts said adjustable length support in response to operation of said pedal assembly.

2. The exercise apparatus of claim 1, wherein said means includes a clutch.

3. The exercise apparatus of claim 1, wherein said means includes a differential.

4. The exercise apparatus of claim 1, wherein said adjustable length member includes a cable having an end secured to a sheave.

5. The exercise apparatus of claim 4, wherein said means includes a clutch.

6. The exercise apparatus of claim 4, wherein said means includes a differential.

7. The exercise apparatus of claim 1, wherein said pedal assembly includes left and right pedals rotatably mounted relative to said body support and diametrically opposed to one another.

8. The exercise apparatus of claim 7, wherein said body support is a seat that faces toward said left and right pedals.

9. The exercise apparatus of claim 1, wherein said body support is a seat.

10. The exercise apparatus of claim 1, wherein force is generated during operation of said pedal assembly, and said means uses a variable amount of said force to adjust said adjustable length member.

11. An exercise apparatus, comprising:

a stationary base;

a body support movably mounted on said base;

a pedal assembly movably mounted on said body support, wherein force is generated during operation of said pedal assembly; and a means for adjusting elevation of said body support relative to said base, wherein said means uses a variable amount of said force to adjust said adjustable length member.

12. The exercise apparatus of claim 11, wherein said means includes a clutch.

13. The exercise apparatus of claim 11, wherein said means includes a differential.

14. The exercise apparatus of claim 11, wherein said means includes an adjustable length of cable interconnected between the body support and the base.

15. The exercise apparatus of claim 14, wherein said means includes a clutch.

16. The exercise apparatus of claim 14, wherein said means includes a differential.

17. The exercise apparatus of claim 11, wherein said pedal assembly includes left and right pedals rotatably mounted relative to said body support and diametrically opposed to one another.

18. The exercise apparatus of claim 17, wherein said body support is a seat that faces toward said left and right pedals.

19. The exercise apparatus of claim 11, wherein said body support is a seat.

20. An exercise apparatus, comprising:

a stationary base;

a seat movably mounted on said base;

at least one force receiving member movably mounted on said base for movement together with said seat, and disposed within reach of at least one limb of a person sitting on said seat;

a differential movably mounted on said base for movement together with said seat, wherein said differential has three shafts, including a first shaft connected to said force receiving member;

a resistance device connected to a second shaft of said differential;

a reel connected to a third shaft of said differential; and a cable having a first end connected to said reel and a second end connected to said base, wherein rotation of said reel in one direction reduces how much cable extends between said reel and said base and thereby moves said seat in a first direction relative to said base, and rotation of said reel in an opposite direction increases how much cable extends between said reel and said base and thereby moves said seat in an opposite, second direction relative to said base.

21. The exercise apparatus of claim 20, wherein said base includes a vertical post, and said seat is movably mounted on said post.

22. The exercise apparatus of claim 20, wherein said at least one force receiving member is a bicycle crank having diametrically opposed pedals.

* * * * *